US005980350A

United States Patent [19]

Amano et al.

[11] Patent Number: 5,980,350

[45] Date of Patent: Nov. 9, 1999

[54] BEAM CONTROL ELECTRODE, ELECTRON GUN PROVIDED WITH THE BEAM CONTROL ELECTRODE, CATHODE-RAY TUBE PROVIDED WITH THE ELECTRON GUN, AND METHOD OF FABRICATING THE BEAM CONTROL ELECTRODE

[75] Inventors: Yasunobu Amano, Tokyo; Yuichi Suzuki, Kanagawa; Koichi Tahara, Nara, all of Japan

[73] Assignee: Sony Corporation, Japan

[21] Appl. No.: 09/241,437

[22] Filed: Feb. 2, 1999

Related U.S. Application Data

[63] Continuation of application No. 08/808,867, Feb. 28, 1997.

[30] Foreign Application Priority Data

Mar. 5, 1996 [JP] Japan ..... 8-047511

[51] Int. Cl.[6] ..... H01J 9/02

[52] U.S. Cl. ..... 445/49

[58] Field of Search ..... 445/49

[56] References Cited

U.S. PATENT DOCUMENTS 3,767,953 10/1973 Bossers ..... 445/49

FOREIGN PATENT DOCUMENTS 21832 2/1980 Japan ..... 445/49

95044 6/1982 Japan ..... 445/49

*Primary Examiner*—Kenneth J. Ramsey

*Attorney, Agent, or Firm*—Ronald P. Kananen; Rader, Fishman & Grauer

[57] ABSTRACT

The present invention provides a cathode-ray tube provided with an electron gun capable of emitting electron beams of vertically elongate cross section.

A beam control electrode (G2) is fabricated by forming beam passage holes (22R, 22G, 22B) in thin portions (20R, 20G, 20B) of a reduced thickness of an electrode plate (18), and forming excess metal relieving slots (40R to 45B) on the opposite sides of the beam passage holes (22R, 22G, 22B), respectively. An electron gun employing the beam control electrode (G2) is capable of automatically correcting the cross section of beams so that the beams form substantially circular spots in the periphery of a screen. Thus, the deterioration of picture quality attributable to the distortion of the cross section of the beams can be avoided and pictures can be displayed in an improved picture quality.

2 Claims, 11 Drawing Sheets

BEAM CONTROL ELECTRODE, ELECTRON GUN PROVIDED WITH THE BEAM CONTROL ELECTRODE, CATHODE-RAY TUBE PROVIDED WITH THE ELECTRON GUN, AND METHOD OF FABRICATING THE BEAM CONTROL ELECTRODE

This application is a continuation of application Ser. No. 08/808,867 filed Feb. 28, 1997.

BACKGROUND OF THE INVENTION

1. Field of the Invention

The present invention relates to a cathode-ray tube (CRT), an electron gun to be employed in the CRT, a beam control electrode included in the electron gun, and a method of fabricating the beam control electrode. More specifically, the present invention relates to an electrode plate having thin portions provided with beam passage holes and excess metal relieving slots for relieving excess metal so that excess metal may not form protrusions when forming the thin portion, used as a beam control electrode, and enabling the accurate disposition of an adjacent electrode at a predetermined distance therefrom to form beams of a desired shape. The shape of the beam in the periphery of a screen can automatically be corrected by the beam control electrode.

2. Description of the Related Art

An electron beam emitted by an electron gun is deflected for the two-dimensional scanning of a fluorescent body to form a desired picture on a screen. The electron beam emitted by the electron gun has a circular cross section and forms a substantially circular spot at the center of the screen as shown in FIG. 5A. However, the electron beam is deformed by electromagnetic deflection and forms horizontally elongate spots in the corners of the screen, namely, the periphery of the screen, as shown in FIG. 5A. A picture formed by such distorted spots of the electron beam is distorted.

A method proposed to correct the distortion of a picture uses an electron beam which forms, for example, a vertically elongate spot at the center of the screen as shown in FIG. 5B. This electron beam, which forms a vertically elongate spot, i.e., a distorted spot, forms substantially circular spots in the corners of the screen as shown in FIG. 5C when subjected to electromagnetic deflection. FIG. 6 shows a conventional color electron gun for a three-gun three-beam type electron gun (color tube). This electron gun emits electron beams of an intentionally deformed cross section. The electron gun is provided with three in-line cathodes KR, KG and KB.

A plurality of plate-shaped or cylindrical grids G1 to G6, i.e., beam control electrodes, are arranged at predetermined intervals in the direction of travel of beams for the cathodes KR, KG and KB. The fifth grid G5 and the sixth grid G6 form a main electron lens (convex lens).

FIG. 7 shows the electron gun in a sectional view. In FIG. 7, the cathode KR is disposed at the center, an electron beam EB deflected by the main electron lens ML reaches a screen 12.

The shapes of spots formed by an electron beam in the corners of the screen can be corrected by shaping the cross section of the beam in a vertically elongate shape, i.e., a shape elongate in the vertical scanning direction, by controlling beam divergence angle θ.

Beam divergence angle θ can be controlled mainly by the shape of the second grid G2. The second grid G2 is formed in a structure shown in FIG. 8 to control beam divergence angle θ.

Generally, beam passage holes 22R, 22G and 22B are formed in thin portions 20R, 20G and 20B, respectively, of the second grid G2 to secure necessary strength for the second grid G2 and to secure a desired divergence angle θ. Formation of such thin portions in an electrode is called coining. As shown in FIG. 9, the thin portions 20R, 20G and 20B formed by coining have a horizontal length, i.e., length along an axis X–X', greater than a vertical length, i.e., length along an axis Y–Y'. The beam passage holes 22R, 22G and 22B are formed at the centers of the thin portions 20R, 20G and 20B, respectively. FIG. 10 is a sectional view taken on the axis X–X' in FIG. 9.

Since the thin portions have an asymmetrical shape (astigmatic coining), portions of the second grid G2 on the side of the vertical scanning direction are thick and a converging lens having a high converging ability is formed, because an electric field is created in the beam passage holes. The converging lens having a high converging ability reduces the divergence angle of the beam.

Since portions of the second grid G2 on the side of the horizontal scanning direction are thin, a converging lens having a low converging ability is formed and hence the divergence angle of the beam is large. Therefore, the beam EB travels through the central portion of the main electron lens ML having a small curvature and a low converging ability with respect to the vertical scanning direction, and the beam EB travels through an outer portion of the main electron lens ML, having a large curvature and a high converging ability with respect to the horizontal scanning direction. Consequently, the beam is converged greatly with respect to the horizontal scanning direction and the beam forms a vertically elongate spot.

Usually, the second grid G2 having the thin portions formed by coining is manufactured by the following process.

FIG. 11 shows only a portion for an R beam of a metal plate used as the second grid. A prepared hole 26R is formed at a predetermined position in a metal plate 18 by punching as shown in FIG. 11A. The prepared hole 26R is formed to relieve excess metal during press working. The metal plate 18 is subjected to press working for coining using a punch 28 as shown in FIG. 11B to form a rectangular thin portion 20R as shown in FIG. 11C.

The prepared hole 26R serves as an excess metal relieving slot during press working and its diameter is reduced as shown in FIG. 11D. A portion of the metal plate 18 having the prepared hole 26R is punched again with a punch 30 to form the beam passage hole 22R of a predetermined diameter as shown in FIGS. 11D and 11E. Thus, the second grid G2 having the thin portion 20R of predetermined dimensions as shown in FIG. 11E is completed. Other thin portions 20G and 20B are formed by the same process and hence the description of processes for forming the thin portions 20G and 20B will be omitted.

It is possible that excess metal is collected in part of the thick portion of the metal plate 18 in a bulge when the forming the thin portion 20R by press working using the punch when forming the second grid G2 by steps shown in FIG. 11. This excess metal cannot be relieved only by the prepared hole 26R, and a protrusion 24 is formed in a portion of the thick portion around the thin portion 20R as shown in FIG. 11F. The formation of the protrusion 24 remarkable when the thin portion 20R must be formed in a very small thickness.

If the protrusion 24 is formed around the thin portion 20R, it is possible that the second grid G2 and the third grid G3 cannot be attached to beadings 14 and 16 (FIG. 7) with the second grid G2 and the third grid G3 spaced a predetermined distance apart. The plurality of grids G1 to G6 are held on the beadings (glass) 14 and 16 at predetermined intervals.

Since the space between the second grid G2 and the third grid G3 is very narrow, the second grid G2 and the third grid G3 are spaced by a spacer 34 as shown in FIG. 10 for a beading process.

If the protrusion 24 of an indefinite height is formed by the coining process, the insertion of the spacer 34 between the second grid G2 and the third grid G3 is obstructed by the protrusion 24 and the second grid G2 and the third grid G3 cannot be held with a design interval therebetween. Consequently, an electron gun having a desired ability cannot be constructed.

OBJECT AND SUMMARY OF THE INVENTION

The present invention is intended to solve such a problem in the conventional beam control electrode and it is therefore an object of the present invention to provide a beam control electrode in which any protrusion is not formed during a coining process, an electron gun provided with such a beam control electrode, a CRT provided with such an electron gun, and a method of fabricating an electrode.

According to the present invention, a beam control electrode comprises an electrode plate provided with beam passage holes to form beam spots of a shape other than a circular shape. The beam passage holes are formed in thin portions of the electrode plate having a thickness smaller than that of other portions of the electrode plate, and the thin portions are provided with excess metal relieving slots to relieve excess metal when forming the thin portions.

The excess metal relieving slots formed in the thin portions relieves excess metal when forming the thin portions and hence any protrusions are not formed around the thin portions by press working. Therefore, spaces between electrodes included in an electron gun can be determined by spacers so that the electrodes are held at accurate intervals when assembling the electron gun. Thus, the electron gun is able to form beam spots of a desired shape. ACRT incorporating this electron gun is able to correct the distortion of beam spots automatically in the periphery of the screen thereof so that pictures are displayed in an improved picture quality.

DESCRIPTION OF THE PREFERRED EMBODIMENT

Figure 6:
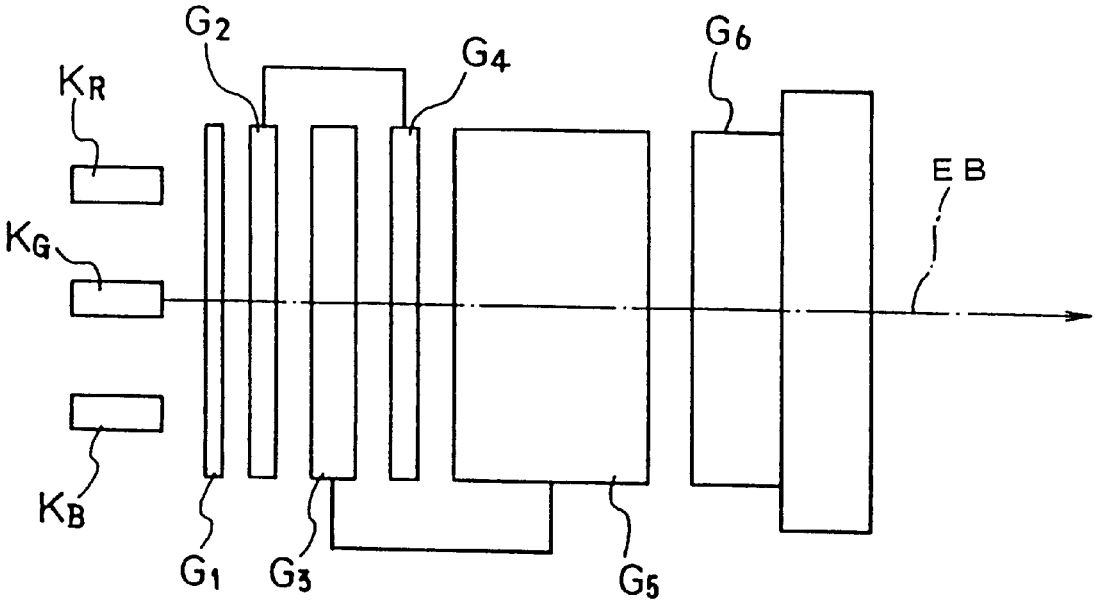
FIG. 6 is a typical side view of an electron gun.
Figure 7:
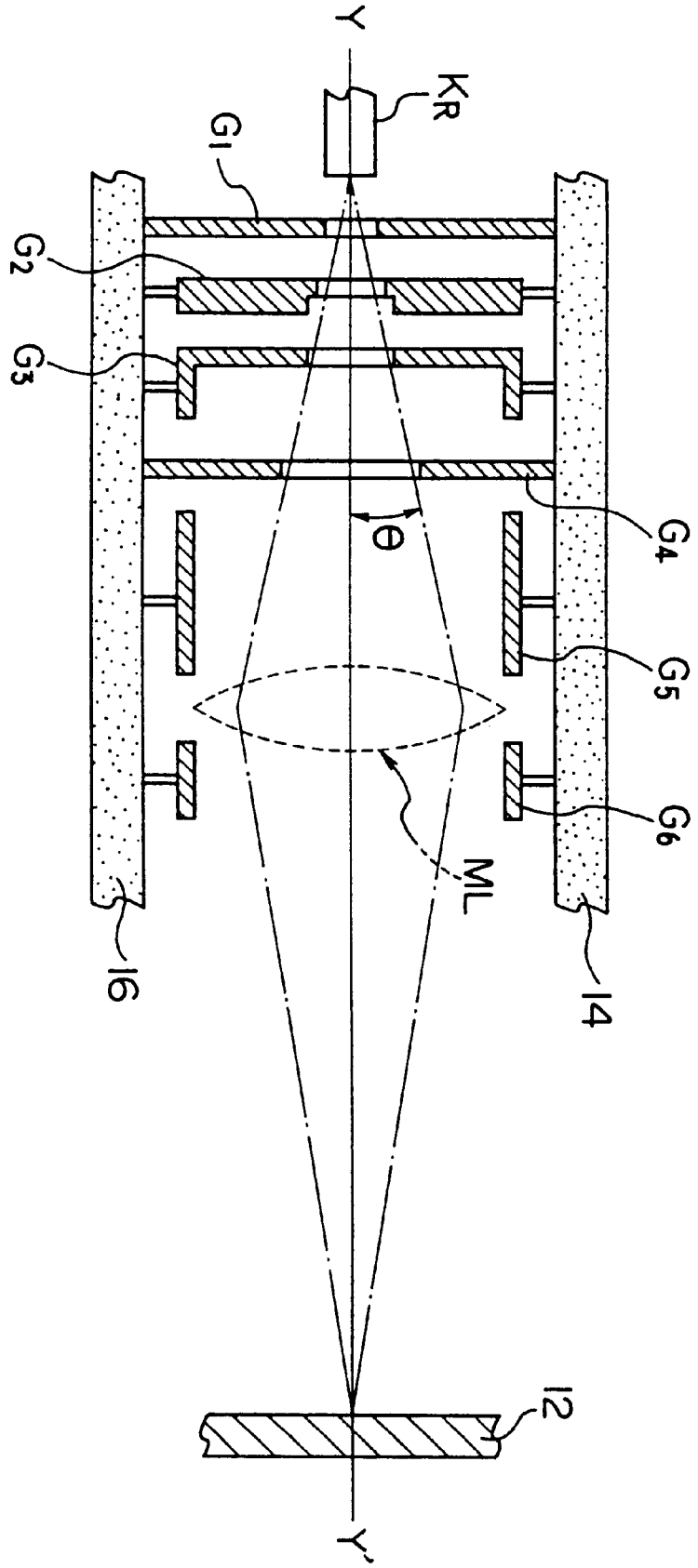
FIG. 7 is a fragmentary sectional view of the electron gun of FIG. 6.
Figure 8:
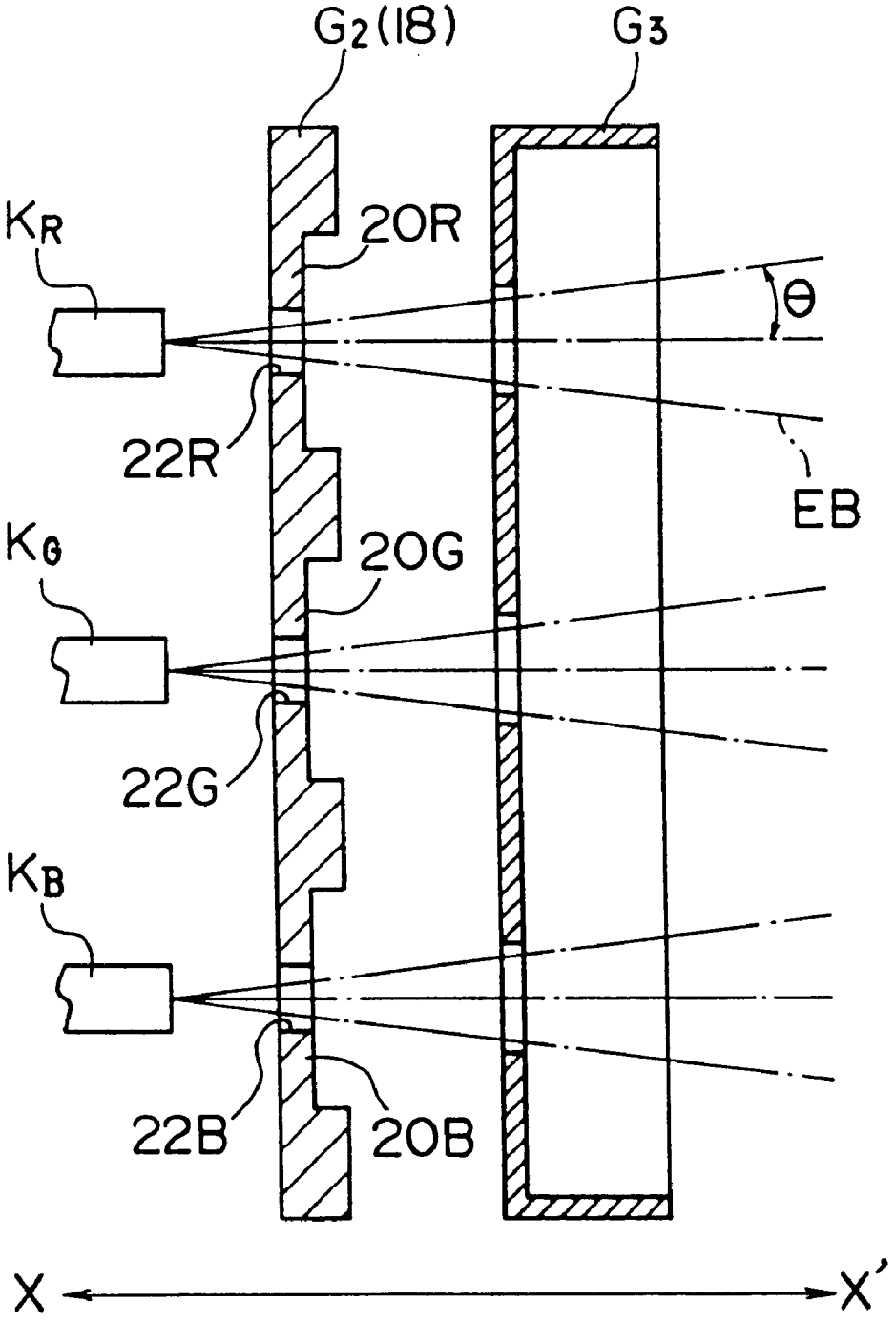
FIG. 8 is an enlarged sectional view of a portion of the electron gun of FIG. 6.
Figure 9:
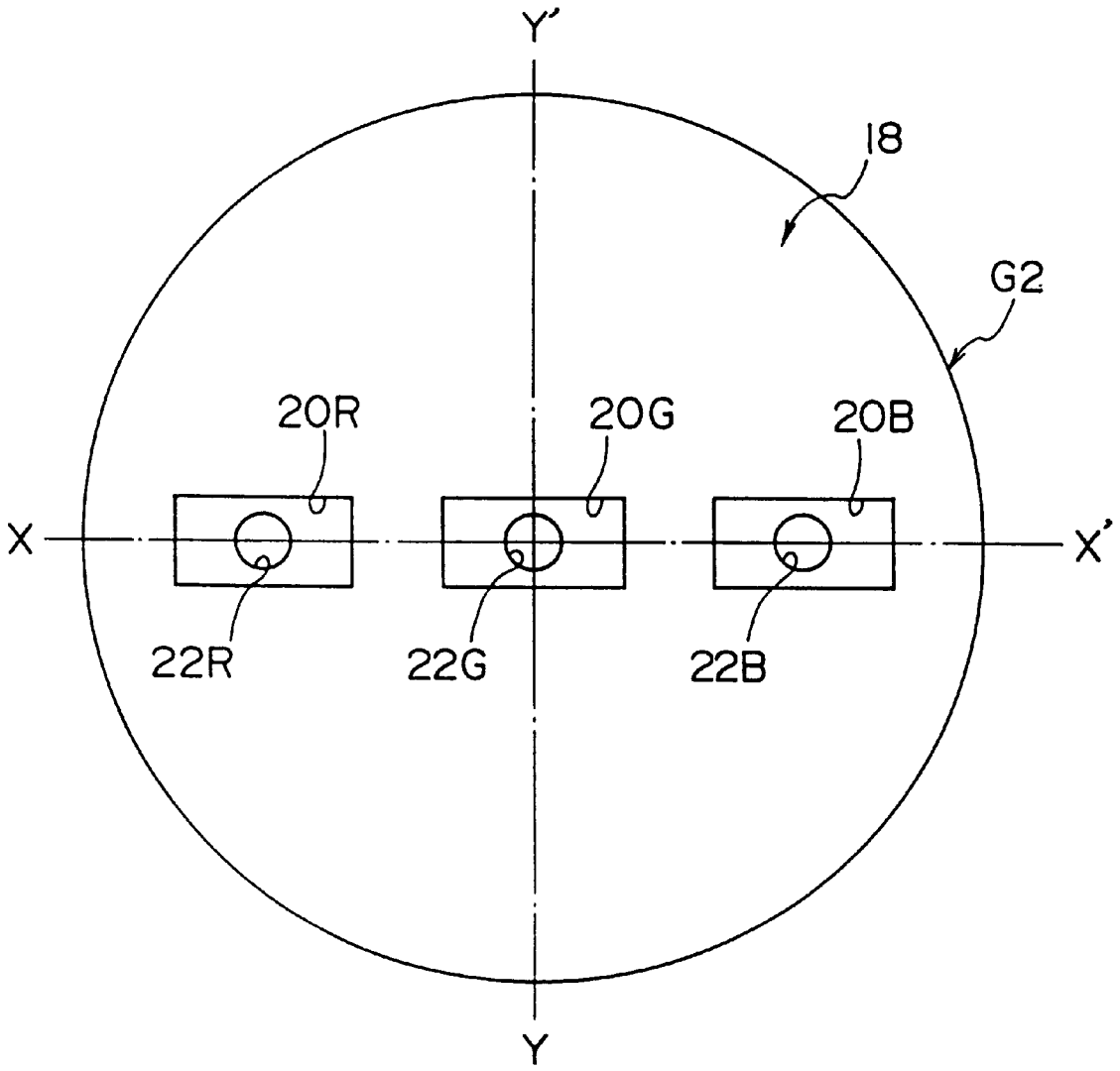
FIG. 9 (PRIOR ART)
FIG. 9 is a plan view of a conventional beam control electrode.
Figure 10:
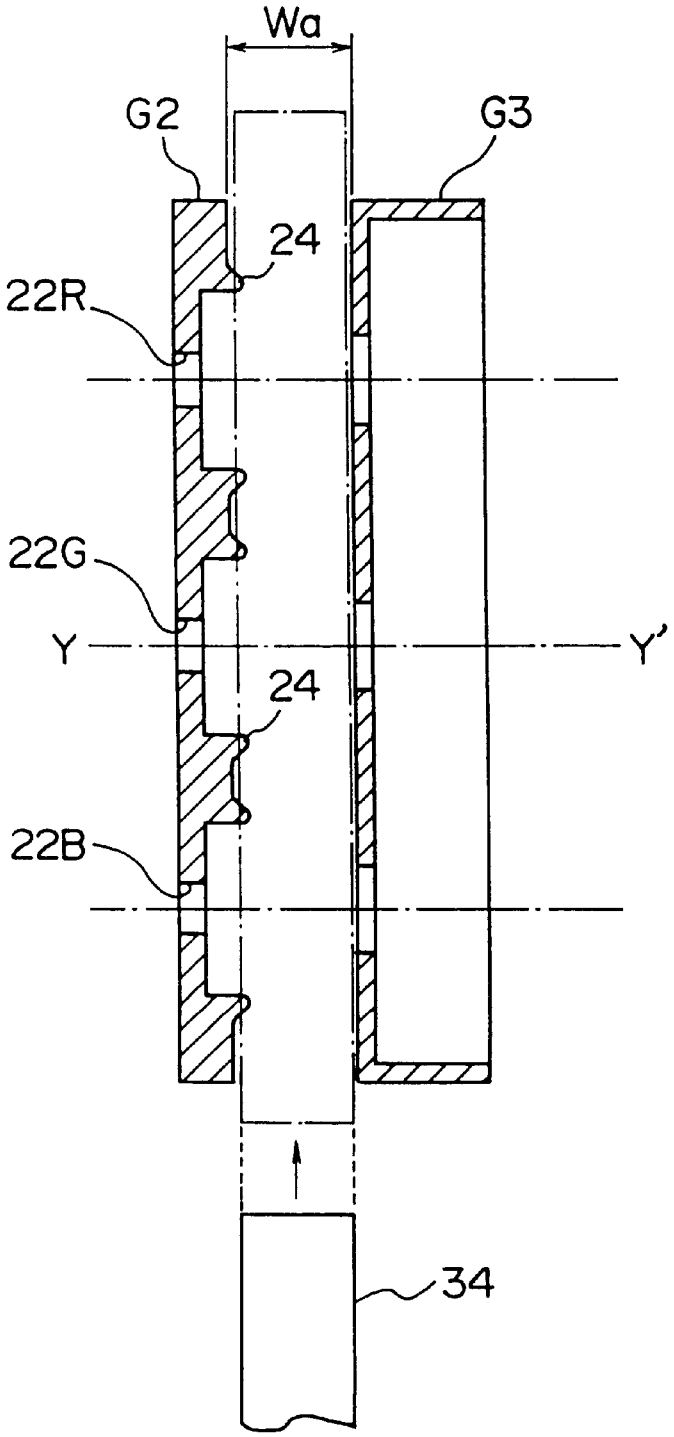
FIG. 10 (PRIOR ART)
FIG. 10 is a sectional view of the beam control electrode of FIG. 9.
Figure 11A:
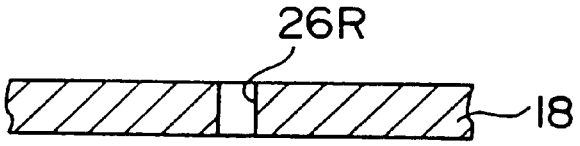
FIG. 11A (PRIOR ART)
FIGS. 11A to 11F are sectional views of assistance in explaining a method of fabricating a beam control electrode.
Figure 11B:
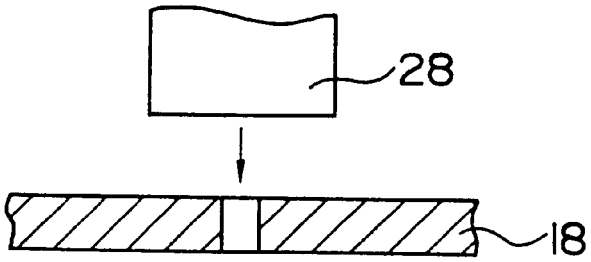
FIG. 11B (PRIOR ART)
Figure 11C:
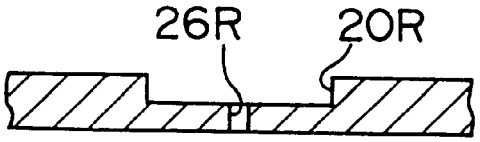
FIG. 11C (PRIOR ART)
Figure 11D:
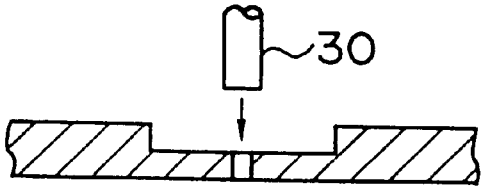
FIG. 11D (PRIOR ART)
Figure 11E:
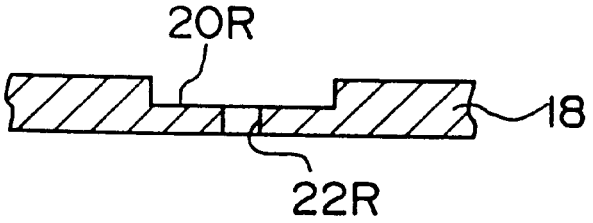
FIG. 11E (PRIOR ART)
Figure 11F:
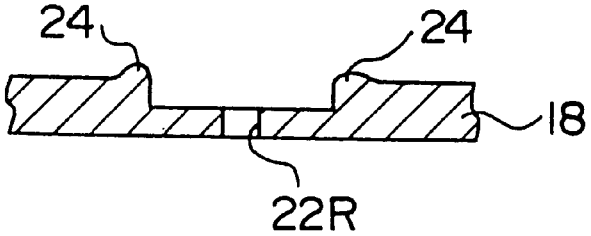
FIG. 11F (PRIOR ART)

An electron gun in a preferred embodiment according to the present invention as shown in FIG. 6 for a three-gun three-beam type electron gun will be described with reference to the accompanying drawings.

Referring to FIG. 6, in a three-gun three-beam type electron gun, the sectional shape of an electron beam is dependent mainly on the configuration of a second grid G2. Therefore, the present invention forms the second grid G2, i.e., a beam control electrode, in a configuration which will be described below.

FIG. 1 is a plan view of a second grid G2, i.e., a beam control electrode, in accordance with the present invention, as viewed from the side of a screen. A beam is moved along a horizontal axis X–X' for horizontal scanning. Beam passage holes 22R, 22G and 22B of a predetermined diameter for three beams are formed in the second grid G2 at predetermined intervals on a horizontal line.

A pair of excess metal relieving slots 40R and 41R, a pair of excess metal relieving slots 42G and 43G, and a pair of excess metal relieving slots 44B and 45B are formed on the opposite transverse ends of the beam passage holes 22R, 22G and 22B, respectively. The excess metal relieving slots 40R to 45B are separated from the beam passage holes to avoid the influence of the excess metal relieving slots 40R to 45B on electric fields to be applied to beams. In this embodiment, the horizontal center distance Wb (FIG. 3) between each of the beam passage holes and each of the corresponding vertically elongate excess metal relieving slots 40R to 45B is about twice the diameter of the beam passage holes 22R, 22G and 22B. Although there is no restriction on the width of the excess metal relieving slots 40R to 45B, the width is slightly smaller than the diameter of the beam passage holes in this embodiment. The length Wc (FIG. 3) of the excess metal relieving slots 40R to 45B is about twice the diameter of the beam passage holes.

The number, the positions and the sizes of the excess metal relieving slots 40R to 45B are selectively determined by taking into consideration the diameter of the beams, the ratio of the area of thin portions to that of thick portions, and the thickness of the electrode plate. The description of FIG. 1 is only an example.

Rectangular thin portions 20R, 20G and 20B are formed in the electrode plate so as to include the excess metal relieving slots 40R to 45B partly. The rectangular thin portions 20R, 20G and 20B are horizontally elongate portions having their long sides parallel to the axis X–X'. As shown in FIG. 1B, the thin portions 20R, 20G and 20B are formed by press working in a thickness about ¾ to ⅕ of the thickness of the electrode plate 18. In this embodiment, the thickness of the thin portions 20R, 20G and 20B is ½ of that of the electrode plate 18.

When the electrode plate 18 is subjected to press working, excess metal of the electrode plate 18 is force to bulge outside a pressing punch. Although the horizontal length of the thin portions increases slightly, the excess metal is relieved perfectly by the prepared hole 26R and the pairs of excess metal relieving slots 40R to 45B. Therefore, although the widths of the excess metal relieving slots 40R to 45B are decreased slightly by press working, the excess metal does not rise in the thick portion and does not form any protrusion like the protrusion 24. Thus, no portion of the electrode plate 18 is caused to rise in protrusions by the excess metal when the electrode plate 18 is subjected to press working to form the thin portions.

Since any protrusion is formed in the electrode plate 18, the second grid G2 and the third grid G3 can accurately be held at a predetermined interval determined by the spacer 34 for beading. Therefore, an electron gun 10 having desired characteristics can be constructed.

Figure 1A:
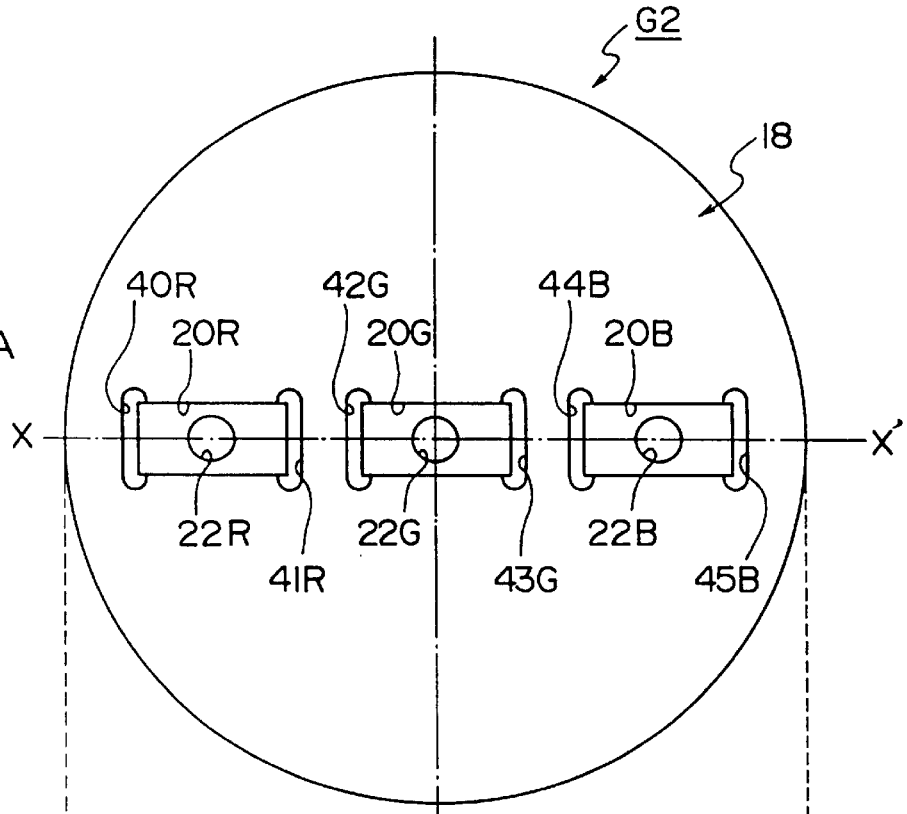
FIGS. 1A and 1B are a plan view and a sectional view, respectively, of an example of a beam control electrode in accordance with the present invention.
Figure 1B:
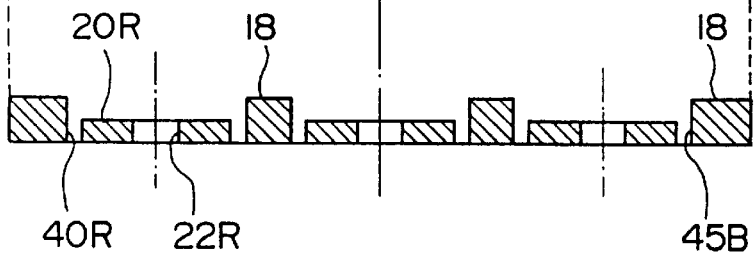

Thus, the horizontally elongate thin portions 20R, 20G and 20B respectively including the beam passage holes 22R, 22G and 22B are formed by press working to obtain the second grid G2 as shown in FIG. 1A.

Figure 5A:
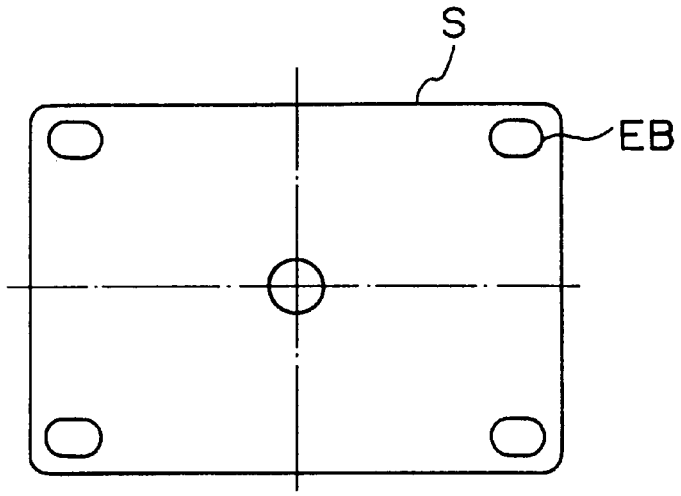
FIGS. 5A to 5C are diagrammatic views of assistance in explaining the distortion of a beam.
Figure 5B:
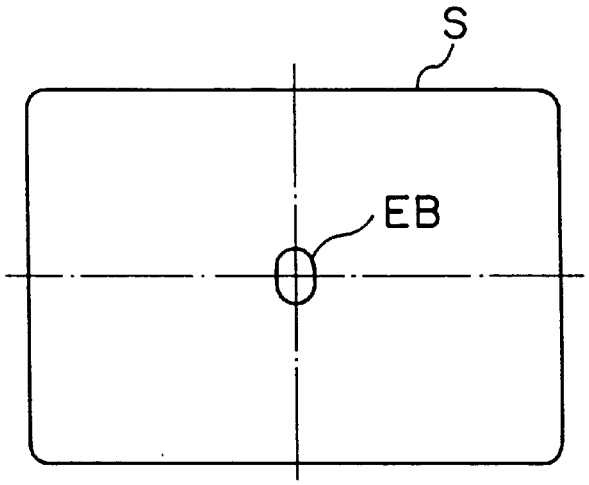
Figure 5C:
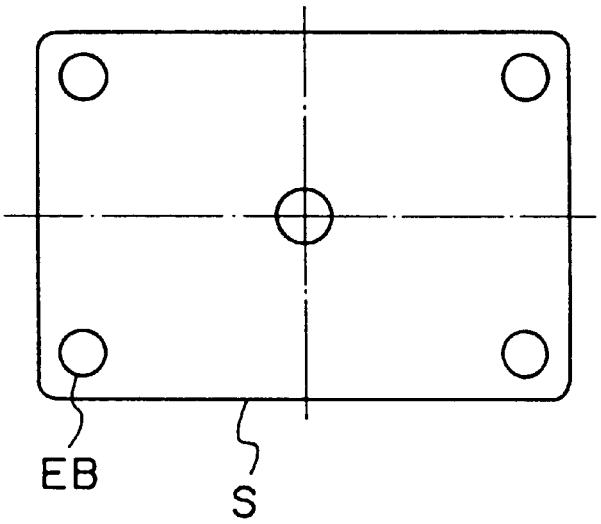

The horizontally elongate beam passage holes 22R, 22G and 22B increase the divergence angle θ of the beams with respect to the horizontal scanning direction, and the beams travel through the peripheral portion of the main electron lens ML, so that the beams undergo the strongest converging action. Consequently, the beam is distorted so as to form a vertically elongate spot at the center of the screen as shown in FIG. 5B. Originally, the beam is distorted so as to form a horizontal spot in the corners of the screen as shown in FIG. 5A, the beam is corrected so as to form a circular spot in the corners of the screen, because the beam is distorted by a deflecting magnetic field in the periphery of the screen.

When a beam is deflected for scanning by an electron gun provided with the foregoing second grid G2, spots of substantially the same shape are formed at different positions on the screen. Therefore a CRT provided with this electron gun realizes a stable shape of a beam for the periphery of the screen and hence pictures can be displayed in an improved picture quality at any position on the screen.

Figure 2A:
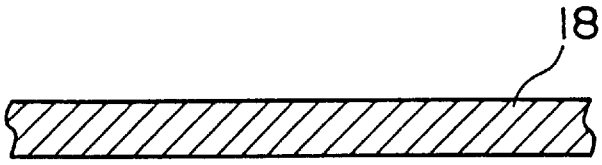
FIGS. 2A to 2E are fragmentary sectional views of an electrode plate in different stages of a method of fabricating a beam control electrode in accordance with the present invention.
Figure 2B:
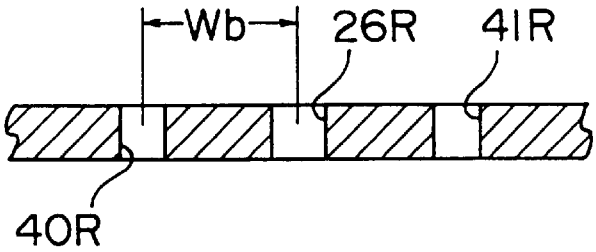

FIG. 2 is a view of assistance in explaining a method of fabricating the foregoing second grid G2. A prepared hole 26R and the excess metal relieving slots 40R and 41R are formed at predetermined intervals on a line in an electrode plate 18 as shown in FIGS. 2A and 2B. FIG. 3A is a plan view of the electrode plate 18 in a step shown in FIG. 2B of the method.

Figure 2C:
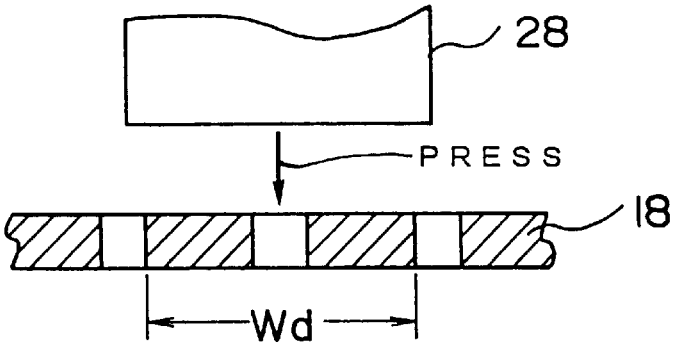
Figure 2D:
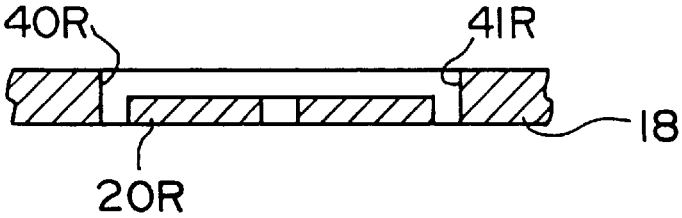
Figure 3A:
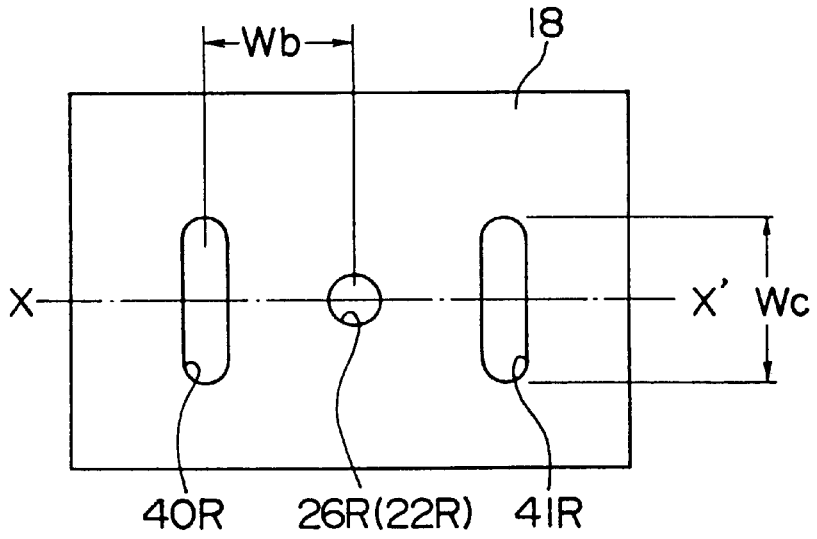
FIGS. 3A to 3C are plan views of the electrode plate in the stages shown in FIG. 2.

The electrode plate 18 is subjected to press working using a rectangular punch 28 as shown in FIG. 2C for forming a thin portion 20R including the excess metal relieving slots 40R and 41R as shown in FIG. 2D. The horizontal length Wd of the thin portion 20R is increased slightly by the press working. However, any excess metal is not caused to rise in a thick portion by the horizontal expansion of the thin portion 20R; that is, any protrusion corresponding to the protrusion 24 formed in the conventional second grid is not formed (FIG. 3B).

Figure 2E:
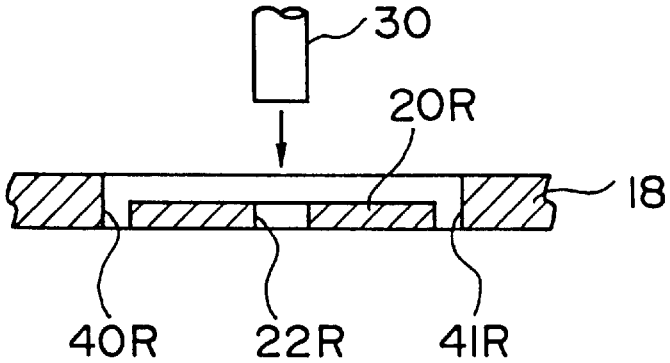
Figure 3B:
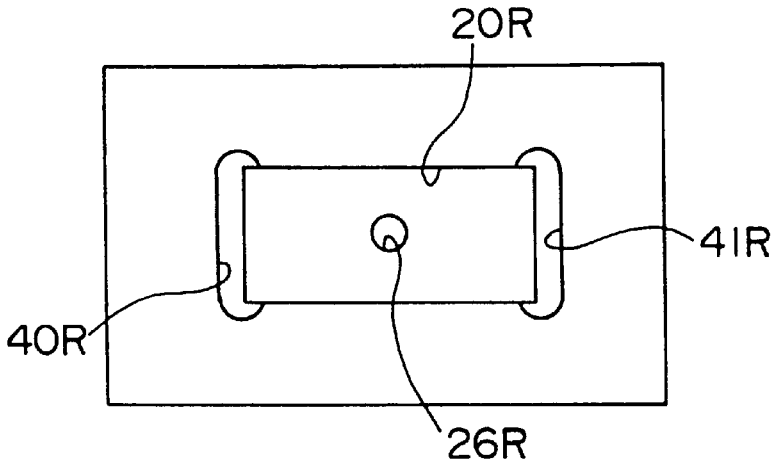
Figure 3C:
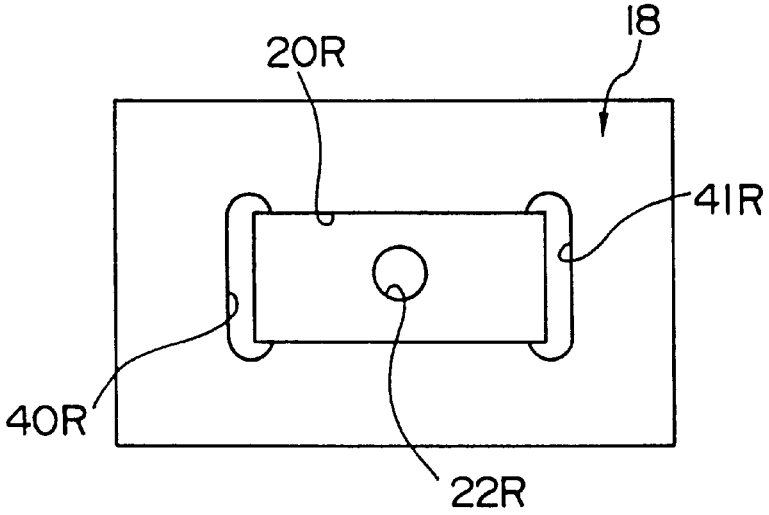

The prepared hole 20R for the beam passage hole 22R is crushed slightly by the press working (FIGS. 2D and 3B). A portion of the electrode plate 18 corresponding to the prepared hole 20R is punched with a punch 30 to form the beam passage hole 22R (FIGS. 2E and 3C). Thus, the second grid G2 having the thin portions is completed.

Thin portions 20G and 20B respectively including the beam passage holes 22G and 22B are formed by the same process and hence the description of processes for forming the thin portions 20G and 20B will be omitted.

The method described with reference to FIG. 2 forms the prepared hole 26R as shown in FIG. 2B. If the second grid G2 is used particularly for controlling fine beams, a beam passage hole may be formed in the last step without forming any prepared hole, because it is possible that a small prepared hole for a small beam passage hole is crushed completely by press working and there is no necessity of forming the prepared hole.

Figure 4A:
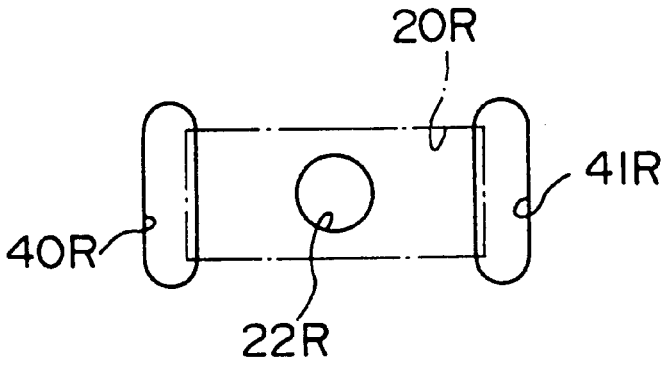
FIGS. 4A to 4D are fragmentary plan views showing possible excess metal relieving slots.
Figure 4B:
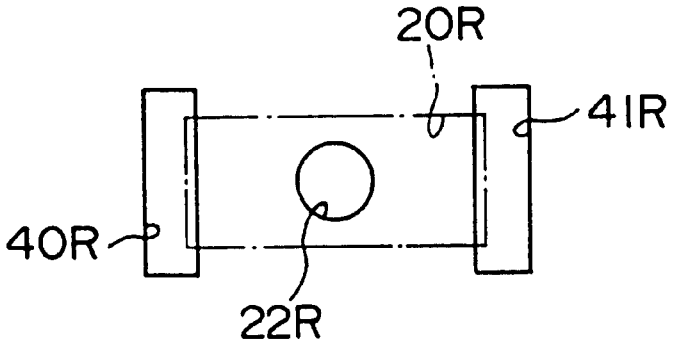
Figure 4C:
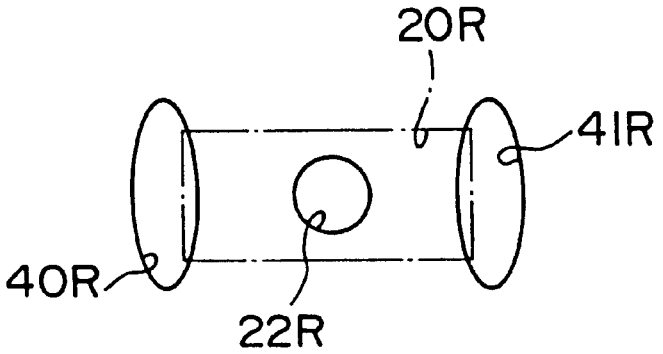

Although the excess metal relieving slots of the second grid in this embodiment are slots as shown in FIG. 4A, the excess metal relieving slots may be rectangular slots as shown in FIG. 4B, elliptic slots as shown in FIG. 4C or slots of any suitable shape provided that the excess metal relieving slots are able to relieve excess metal during metal working.

Figure 4D:
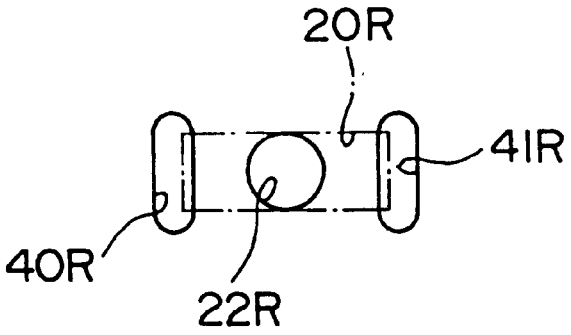

The vertical length of the thin portions may be equal to the diameter of the beam passage holes as shown in FIG. 4D. As mentioned above, the excess metal relieving slots are separated from the corresponding beam passage hole in order that the electric field is not affected by the excess metal relieving slots. It goes without saying that some contrivance, such as increasing the size of the excess metal relieving slots 40R to 45B, must be incorporated into the invention when the thin portions 20R, 20G and 20B are formed in a thickness about ⅕ of that of the electrode plate 18.

Although the invention has been described in terms of an embodiment which is designed to shape beams in a vertically elongate cross section, there is not any particular restriction on the shape of beams. The present invention is applicable to an electron gun other than that for a three-gun three-beam type electron gun.

As is apparent from the foregoing description, according to the present invention, any protrusions are not formed in the thick portion of the beam control electrode when forming the thin portions by press working, because the beam control electrode is provided with the excess metal relieving slots in combination with the beam passage holes. Therefore, the beam control electrode can be formed with a high accuracy. The beam control electrode is suitable for intentionally deforming the sectional shape of beams.

The electron gun employing the beam control electrode of the present invention is capable of readily controlling beams in a desired sectional shape, so that the distortion of the sectional shape of beams in the periphery of the screen of a CRT employing the electron gun can easily be corrected, which improves picture quality. Since the sectional shape of beams can be corrected by the electron gun without requiring any special correcting means, the construction of the CRT can be simplified accordingly. Thus, the electron gun of the present invention is very suitable for use on a three-gun CRT.

What is claimed is:

1. A method of fabricating a beam control electrode, comprising steps of:

forming a prepared holes and pairs of rectangular excess metal relieving slots spaced a predetermined distance apart from the prepared holes, respectively, in a metal plate;

press-working the metal plate to form thin portions including the pairs of excess metal relieving slots in the metal plate;

and punching portions of the metal plate including the prepared holes to form beam passage holes.

2. A method of fabricating a beam control electrode, comprising steps of:

forming pairs of rectangular excess metal relieving slots at positions spaced a predetermined distance apart from positions where beam passage holes are to be formed, respectively, in a metal plate;

press-working the metal plate to form thin portions including the excess metal relieving slots in the metal plate; and punching the metal plate to form the beam passage holes in the metal plate.

* * * * *